United States Patent [19]

Hutson

[11] Patent Number: 4,522,242

[45] Date of Patent: Jun. 11, 1985

[54] HYDRAULIC FED LOG DEBARKER

[76] Inventor: James H. Hutson, Rte. 4, Box 925, Pell City, Ala. 35125

[21] Appl. No.: 430,794

[22] Filed: Sep. 30, 1982

[51] Int. Cl.[3] ..... B27L 1/00

[52] U.S. Cl. ..... 144/208 E; 91/514; 91/451; 91/517; 137/346; 144/341; 210/168; 226/4

[58] Field of Search ..... 144/208 R, 208 E, 208 F, 144/340, 341; 137/346, 518, 883; 91/451, 452, 514, 517; 210/168; 226/4, 177, 187, 193, 168

[56] References Cited

U.S. PATENT DOCUMENTS

| | | | |
|---|---|---|---|
| 700,845 | 5/1902 | Spencer . | |
| 2,005,799 | 6/1935 | Nicholson et al. | 144/208 |
| 2,270,943 | 1/1942 | Freundel et al. | 91/514 |
| 2,423,264 | 7/1947 | Stephens | 91/514 |
| 2,426,817 | 9/1947 | Charlton et al. | 210/168 |
| 2,430,097 | 11/1947 | Bauer | 210/168 |
| 2,625,968 | 1/1953 | Eklund et al. | 144/208 |
| 2,775,274 | 12/1956 | Anderson | 144/208 |
| 2,785,715 | 3/1957 | Brundell et al. | 144/247 |
| 2,786,499 | 3/1957 | Brundell et al. | 144/208 |
| 2,787,304 | 4/1957 | Brundell et al. | 144/208 |
| 2,788,034 | 4/1957 | Brundell et al. | 144/208 |
| 2,821,220 | 1/1958 | Nicholson | 144/249 |
| 2,855,010 | 10/1958 | Leffler | 144/208 |
| 2,857,945 | 10/1958 | Brundell et al. | 144/208 |
| 2,860,672 | 11/1958 | Brundell et al. | 144/208 |
| 2,903,028 | 9/1959 | Brundell et al. | 144/208 |
| 2,918,952 | 12/1959 | Searle | 144/208 |
| 3,053,294 | 9/1962 | Andersson | 144/208 |
| 3,189,067 | 6/1965 | Dillingham | 144/208 |
| 3,196,912 | 7/1965 | Brundell et al. | 144/208 |
| 3,263,720 | 8/1966 | Brock et al. | 144/208 |
| 3,490,665 | 1/1970 | Jonsson | 226/4 |
| 3,552,456 | 1/1971 | Johansson | 144/208 |
| 3,587,684 | 6/1971 | Bush, Jr. | 144/208 |
| 3,774,660 | 11/1973 | Morey et al. | 144/208 |
| 3,850,081 | 11/1974 | Joelson | 91/517 |
| 3,922,954 | 12/1975 | Gustaffsson et al. | 91/517 |
| 3,955,473 | 5/1976 | Oxley et al. | 91/514 |
| 4,024,797 | 5/1977 | Johnson | 91/451 |
| 4,036,270 | 7/1977 | Bright | 144/208 |
| 4,122,877 | 10/1978 | Smith et al. | 144/208 |
| 4,325,663 | 4/1982 | Lee | 210/168 |
| 4,361,488 | 11/1982 | White et al. | 210/168 |

OTHER PUBLICATIONS

"Spare Parts Catalog and Instruction Book 21" and 26" Cambio Barker"—Soderhamn Machine Manufacturing Company.

*Primary Examiner*—W. D. Bray

*Attorney, Agent, or Firm*—Lalos, Leeds, Keegan, Marsh, Bentzen & Kaye

[57] ABSTRACT

A log debarker of the hollow-head type having a rotor journaled in a stator for rotation about a longitudinal axis of the rotor. A plurality of debarking tools are attached to the rotor for debarking a log being moved axially through the rotating rotor. Three independently and hydraulically-powered infeed spiked rollers are positioned on the infeed end of the stator for feeding logs into the rotor and three independently and hydraulically-powered outfeed spiked rollers are positioned on the outfeed end. The rollers are powered at differing rotational speeds to accommodate logs of uneven surfaces. An air-operated tensioning system including a quick release valve adjusts the position of the infeed and the outfeed rollers urging them towards the longitudinal axis and automatically jogs the rollers open when they are unable to mount a log. A lubricating system having lubricant filtering and flow control capabilities lubricate and flushes the bearings for the rotating rotor.

7 Claims, 9 Drawing Figures

HYDRAULIC FED LOG DEBARKER

FIELD OF THE INVENTION

This invention relates to log debarking machines through which the logs are axially inserted and restrained against rotation as their bark is removed. It further relates to the so-called hollow head debarker. It also relates to a means for retrofitting existing debarking machines to accommodate greater feed speeds and logs that are uneven in thickness due to knots or other protrusions.

BACKGROUND OF THE INVENTION

This invention is particularly directed to improvements to hollow head log debarkers of the type as comprehended, for example, by U.S. Pat. No. 2,857,945, the disclosure of which is hereby incorporated by reference in its entirety. The principal of that prior art machine is that logs while being restrained from rotating are axially inserted into a hollow head. Blunt, individually tensioned bark tools mounted in the head are then rotated around the log as the log is fed through the hollow head. The compressive force between the tool and the bark produces a shearing force higher than the strength of the intermediate sap peel, the so-called cambium layer, thus, stripping the bark off of the log. The working parts of the machine consist of the rotor which carries the shafts of the barking tools and which rotates around the log during the debarking process, and a feed mechanism for feeding the logs through the rotor. The feed mechanism comprises six feed arms each with spiked rolls, three on the infeed side of the rotor and three on the outfeed side. The rotor is carried in a ball bearing and is driven by poly-V belts from the drive shaft.

The feed rolls were driven through a ring gear and pinion arrangement by a chain which runs inside the rotor housing and is also driven by a belt from the drive shaft. Thus, the feed rolls were tied together so that all of the rolls would turn at exactly the same speed. Where the logs were uneven in any respect the logs were either not fed through or the debarker suffered a mechanical breakdown. A linking system further insured that the feed rolls in each of the two sets were maintained an equal distance from the longitudinal axis of the rotor. A pair of rubber tension cylinders were used to keep the linking system tensioned.

The rotor bearing and the feed roll bearings ran in an oil bath. The oil, which was a high viscosity oil, (90 SAE) for the rotor bearing was carried up from the bath to the bearing by the feed rolls driving chain, this being lubricated at the same time. The barking tools were opened automatically by a projecting lip on the infeed side, the barking pressure being produced by rubber bands stretched between the tool shaft levers and pegs on the tension ring. By merely turning the ring, the pressure on all of the tools was uniformly increased or decreased.

Inasmuch as in the past all logs brought to debarking facilities were prime, short logs straight with few knots or protrusions and well groomed, the prior method of tying all six feeding spike rolls together with no latitude in individual movement proved sufficient. Additionally, the manufacturing facilities were of a lower production than is needed to meet today's plant requirements. The feed speed of the prior machines was slow and in all cases was one hundred and fifty feet per minute or less.

The impact loading of the feed rolls was low because of these low feed speeds and of the short logs used which created a minimum of impact to the rigid mounted feed rolls and tools. The prevailing thought was that only prime logs in short log form with very few knots could produce good lumber. There were no tops also because they were sent to a large drum type debarker in short wood form. In these drums a number of short logs were threaded simultaneously and the bark was removed by the friction of the logs against each other and against the walls of the drum as the drum was rotated. Also no swell butts were sent to the prior machines because they were either left in the forest or sent to those debarking drums. This prior machine as described in the aforementioned patent performed well by the standards set for that era for which it was designed, built and used, but now a shortage of fiber requires a new era of debarking machines.

The lack of sufficient manpower to work in forest log selection has left only one viable method—total tree harvesting, that is, stripping the land of all of its fiber and bringing all this product to one location called the merchandising facility where all trees, regardless of length, size, sweep, knots, swelled butts, or kinorshum, have to be run through a hollow head debarker and either cut to log length and sent to a solid fiber (lumber or plywood) processing facility or chipped for the pulp industry. High labor costs have made it impractical to be selective in tree selection, and thus all logs are now brought to the log processing facility. Also, because of labor and capital costs, there are fewer plants and production at each plant has to increase which means that each debarker must increase in speed up to about 300 feet per minute. This increase in speed must also be made in view of the deteriorating quality of the logs to be debarked. This has caused shock loading to the feed means, the self opening tools, the rotor, and throughout the entire machine. The prior debarkers with their rollers operating at the same speeds could not handle these uneven logs. Expensive down time and maintenance costs have resulted and in some cases extra machines have to be supplied for the manufacturing operations. It was also found that the prior machines would not develop sufficient force required to feed an entire tree-length log through the debarking apparatus at high enough speeds. Also, inasmuch as the cost for manufacturing the debarking machines is great, it is preferable, where possible to retrofit existing machines to meet these new conditions in this new era of debarking machines.

In past machines, the bearings on which the rotor rotated were lubricated by an oil system which used a chain that dipped into an oil sump and carried the oil to the top of the bearing at which time the high viscosity contaminated oil then fell over the bearings and back to the oil sump. It was found that bark, dust, and other contaminants were not being flushed out of the system. The oil being used was of a very high viscosity and did not act as a flushing agent to flush out these contaminants and thus the life of the bearings was shortened. It was also difficult to maintain a proper flow of oil over the bearings.

It should also be noted that in the prior machines a rubber type cylinder or air cylinders with inefficient operating features were used with the tension linkage means to keep the arms and rollers in constant contact with the log. These rubber type or air cylinders did not provide the necessary shock dampening means. They also did not provide a quick open jog for quickly opening the arms when an obstruction was met.

OBJECTS OF THE INVENTION

Accordingly, it is the principal object of the present invention to provide an improved hollow head debarking machine.

Another object of the present invention is to provide a novel log debarker with a greater feed speed.

A further object of the present invention is to provide a log debarker which accommodates logs that are not well groomed and have swelled butts, knots and other protrusions.

A still further object of the present invention is to provide a log debarker which prevents dirt, wood chips, and other contaminants from entering the rotor and flushes out those which do enter.

Another object is to provide an improved log debarker which has a jog or quick release cushion system for opening the feed mechanisms to accommodate larger or misaligned logs.

A further object is to provide a debarker which is cushioned to have less shock loading on entering and feeding through the machine, and thus is less damaging to its mechanical parts.

A still further object is to provide a debarker with variable speed rollers.

Another object is to provide a debarker with the main bearing having a flush through filtered oil system.

A further object is to provide a debarker with an emergency cut off alarm system to shut the operation down when there is insufficient oil.

A still further object is to provide a debarker that is easy to maintain and for which parts are easily accessible and thus replaceable.

Another object is to provide a debarker with an automatic fluid cushioned feed opening means.

A further object is to provide a means for easily retrofitting existing debarking machines and preferably using fewer parts.

A still further object is to provide a debarker having shorter drive shafts with load carrying bearings in the proximity of the load center for the roller feed arms.

Another object is to provide a debarker which maintains a uniform feed pressure irrespective of the log diameter.

Other objects and advantages of the present invention will become more apparent to those persons having ordinary skill in the art to which the present invention pertains from the foregoing description taken in conjunction with the accompanying drawings.

THE DRAWINGS

DESCRIPTION OF THE PREFERRED EMBODIMENT

Figure 1:
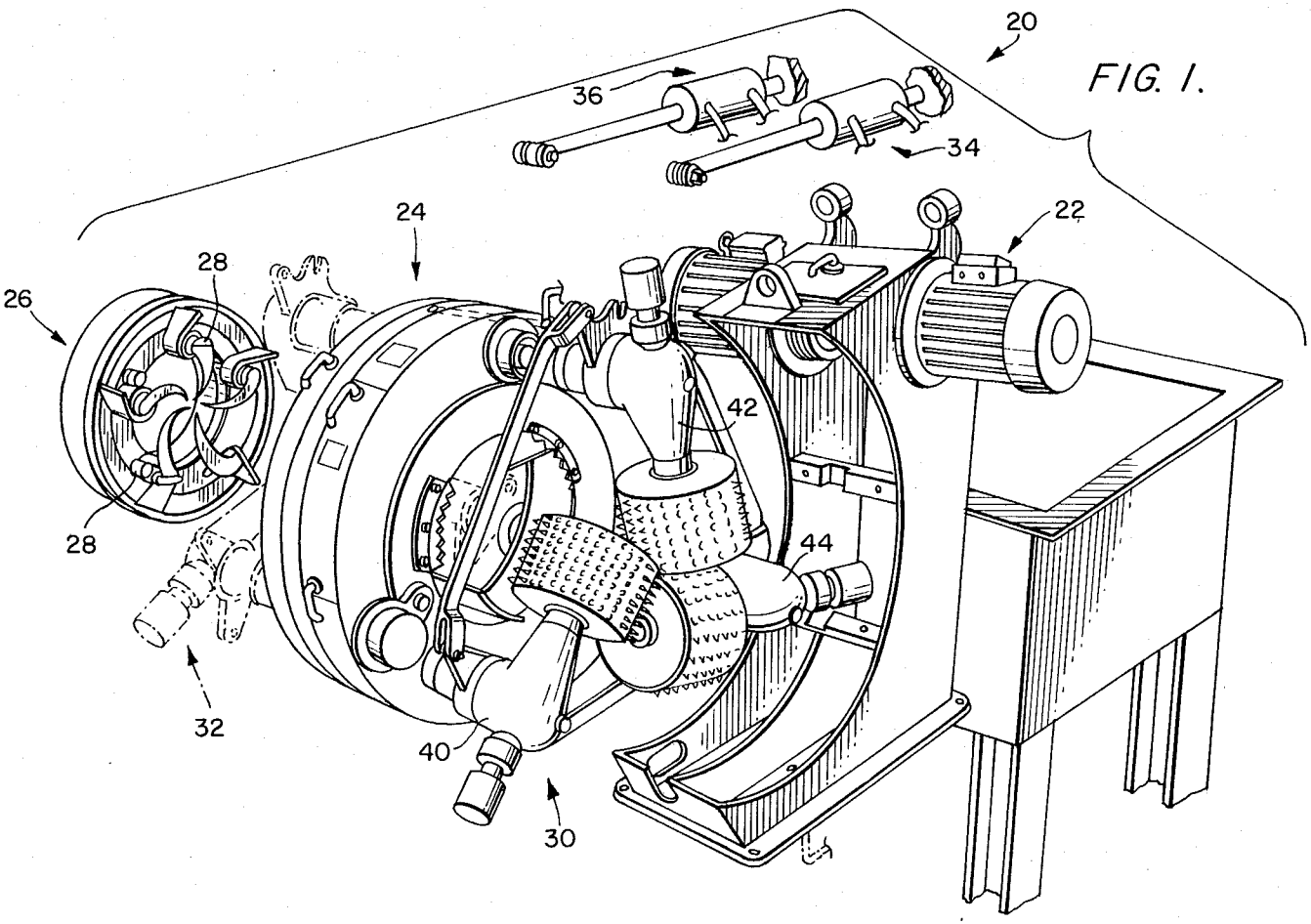
FIG. 1 is a perspective view of a debarking machine embodying the present invention illustrating the parts in exploded relation.

Referring to FIG. 1, there is illustrated a machine of an embodiment of the present invention shown generally at 20 for debarking logs of various lengths and diameters. This machine generally includes a support frame shown generally at 22, a rotor housing assembly shown generally at 24 supported in frame 22, and a rotor assembly shown generally at 26 to which are attached a plurality of debarking tools 28, rotor assembly 26 being journaled in rotor housing assembly 24 for rotation about a longitudinal axis thereof. Each of the tools is made of high grade steel and is able to deflect in the direction of log travel, and includes a cushioning means to cushion it when it falls off knots or the end of the log. An infeed feed works assembly shown generally at 30 is mounted to the infeed side of rotor housing assembly 24 and a corresponding outfeed feed works assembly 32 is mounted to the outfeed side. An infeed tensioning system shown generally at 34 is mounted at one end to support frame 22 and at its other end to infeed feed works assembly 30. A corresponding outfeed tensioning system 36 is likewise mounted to support frame 22 and to outfeed feed works assembly 32. The machine as pictured in FIG. 1 typically is mounted above ground and about two to ten feet above the oiler shown generally at 38 in FIG. 7 which provides filtered lubricating oil to the bearings in which rotor assembly 26 is journaled.

Figure 2:
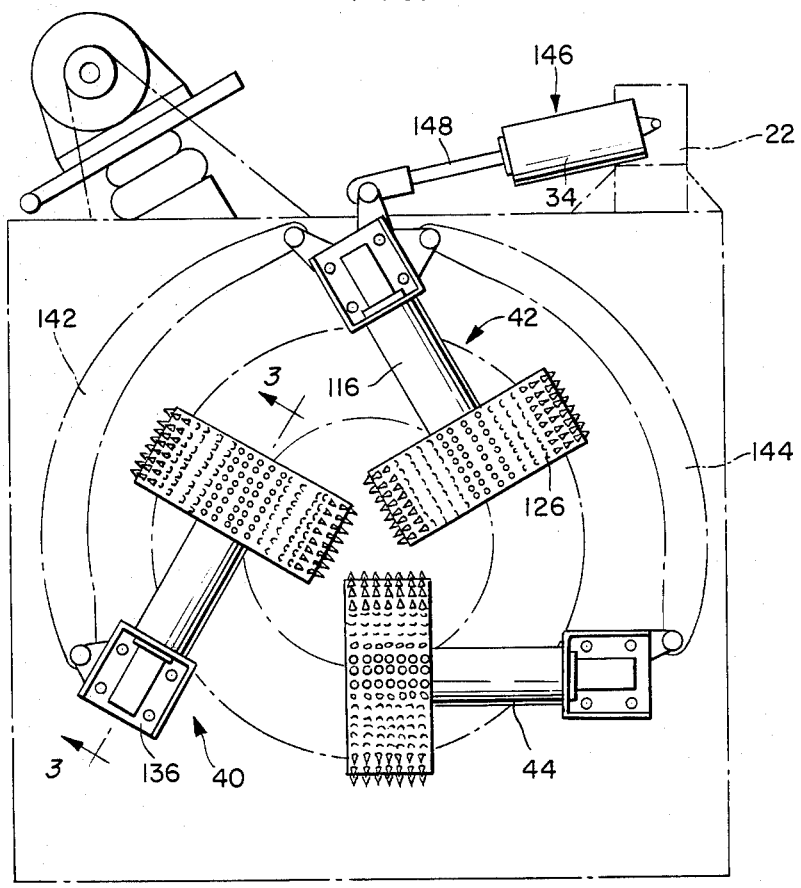
FIG. 2 is a side end view of a second embodiment of a debarking machine embodying the present invention.
Figure 3:
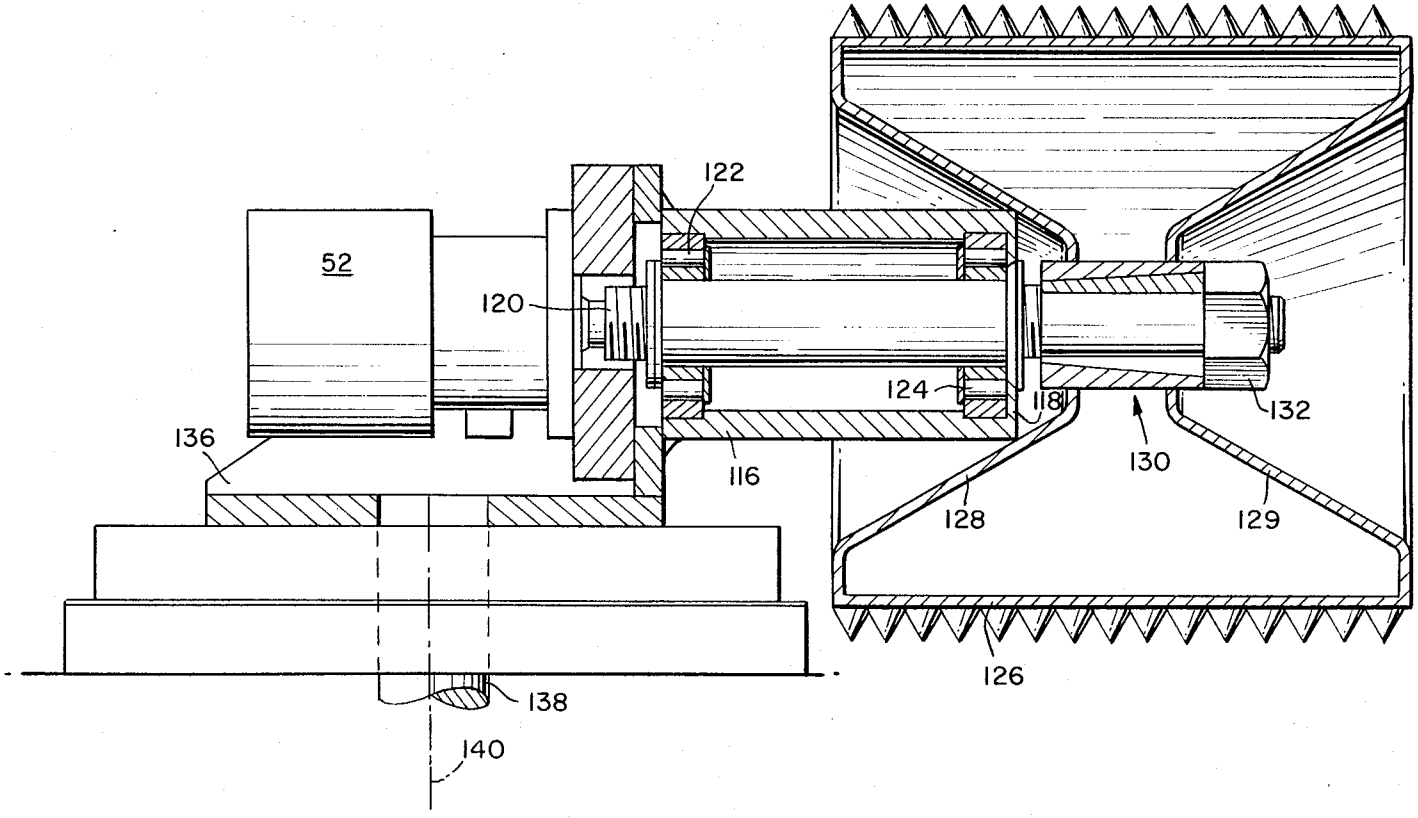
FIG. 3 is a cross-sectional view taken along line 3—3 of FIG. 2.
Figure 4:
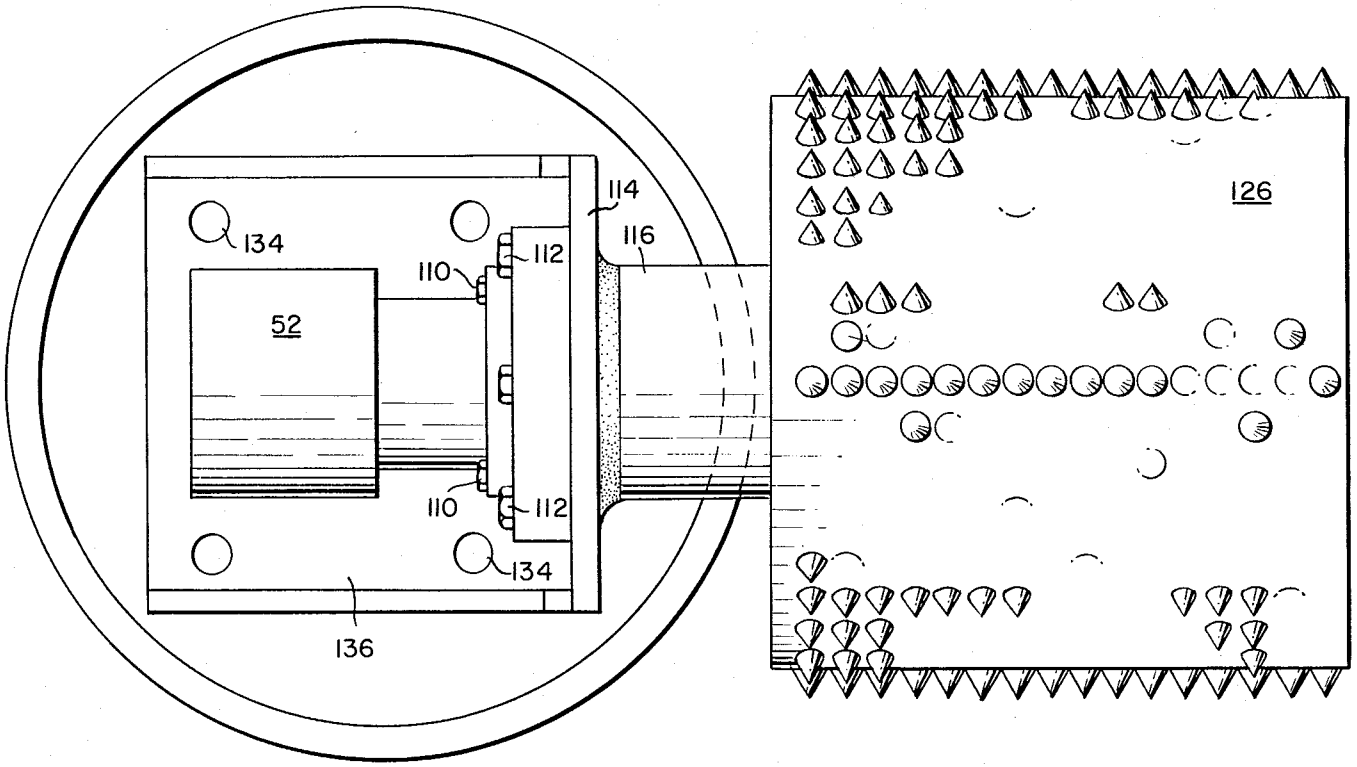
FIG. 4 is a side plan view of the feeder arm of FIG. 3.
Figure 5:
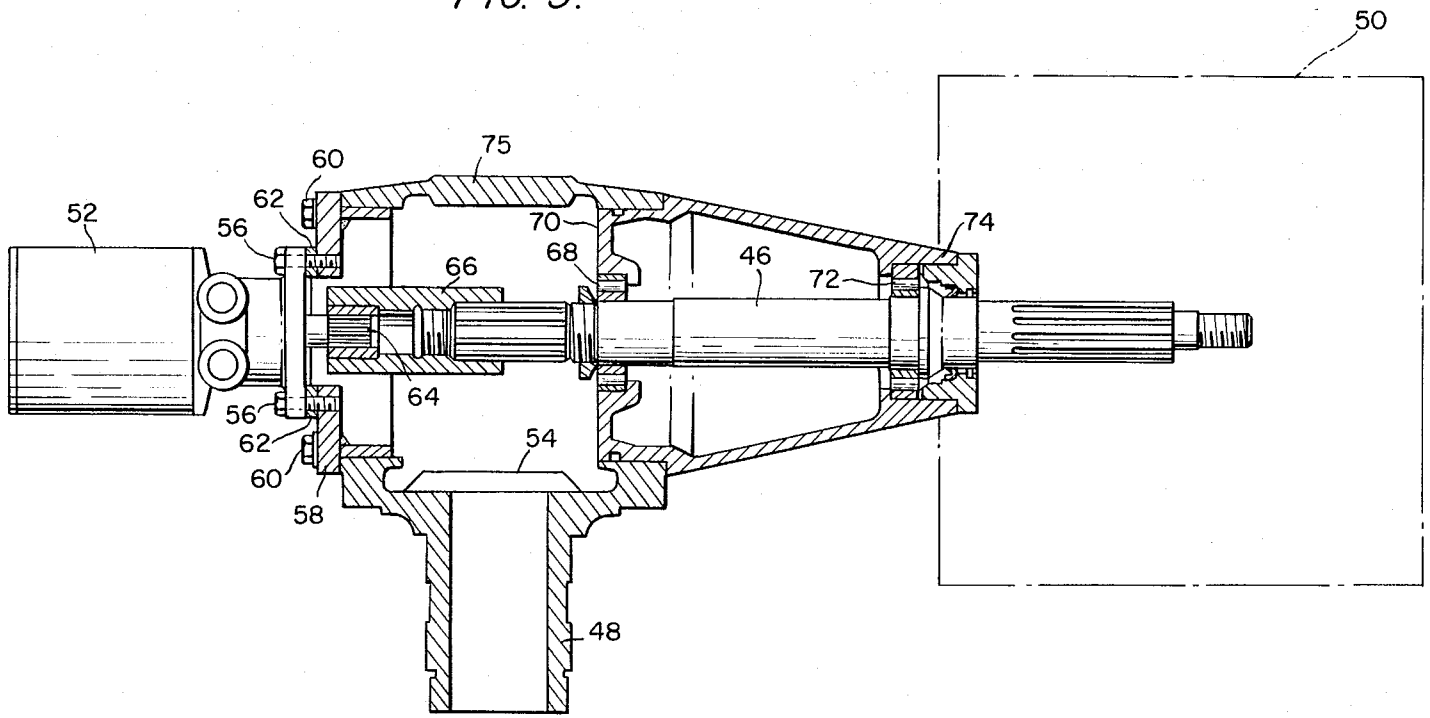
FIG. 5 is a cross-sectional view of a prior art feeder arm but including another embodiment of the present invention.
Figure 9:
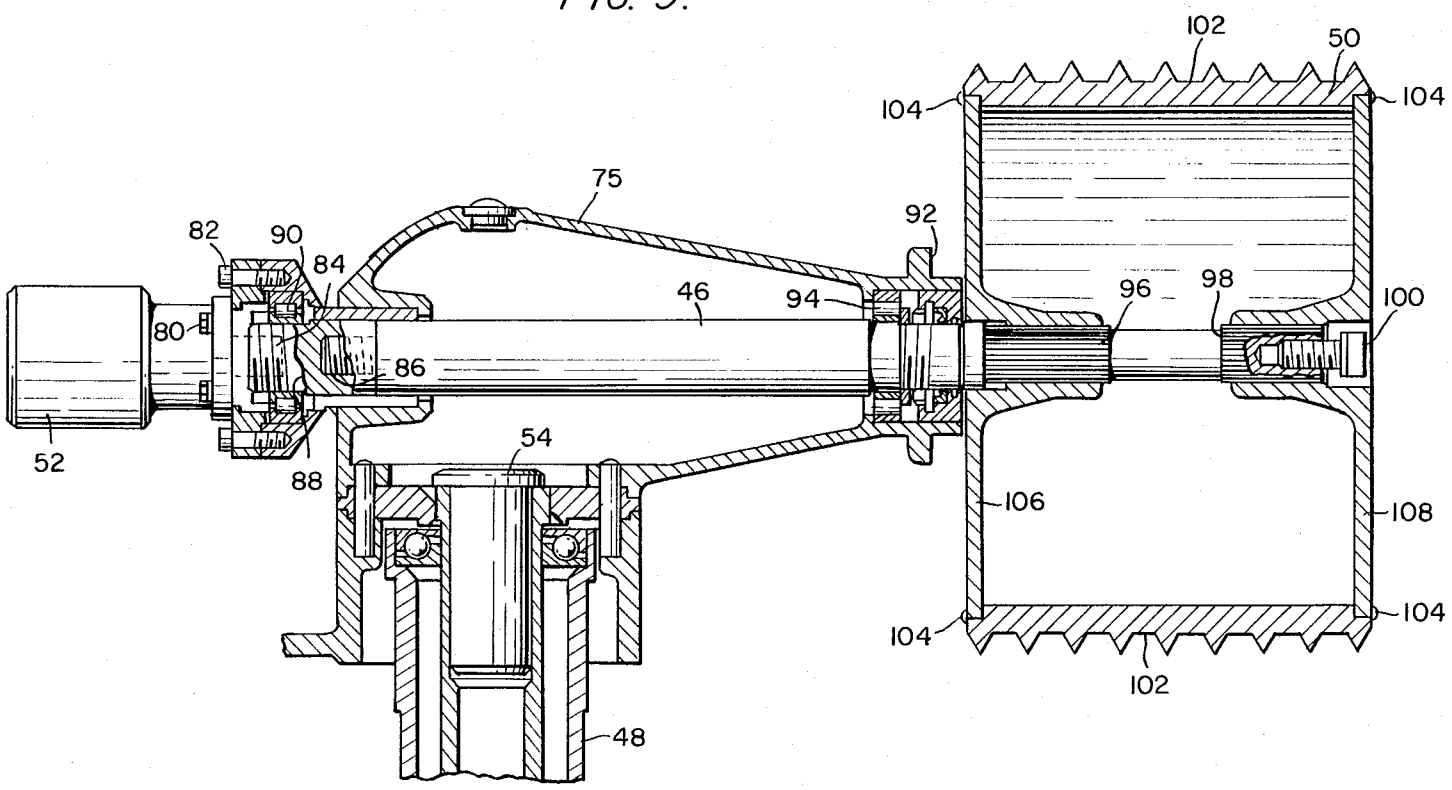
FIG. 9 is an enlarged cross-sectional view of the feeder arm of FIG. 1.

As shown in FIGS. 1 and 2, infeed feed works assembly 30 (and outfeed feed works assembly 32) comprises three feed arms 40, 42, and 44 arranged in a triangular fashion with their longitudinal rotational axis lying in a common plane generally perpendicular to the plane of rotation of the rotor assembly. The embodiments of FIGS. 5 and 9 illustrate a retrofitting of two types of existing debarking machines in which the power means for the drive shaft 46 was provided by a drive shaft (not shown) rotating in sleeve member 48 and drivingly connected to drive shaft 46 by a ring gear (not shown). Each of these drive shafts for each of the feed arms was driven by the same motor so that each of the spiked drive rolls 50 mounted at the end of drive shafts 46 rotated with the same force and speed. Inasmuch as drive shafts 46 are now driven by axially aligned hydraulic motors 52 mounted to the ends of the arms the drive shafts have now been removed and sleeve members 48 in which these drive shafts rotate plugged with plugs 54. FIGS. 3 and 4 illustrate a new construction for the present invention for new roll arms 40, as will be described in greater detail later.

Referring to FIG. 5, the modified or retrofitted 18, 24 or 30 inch feed arm assembly is illustrated. Hydraulic motor 52 is bolted by bolts 56 to motor adaptor member 58 which in turn is bolted by bolts 60 to the outboard end of the sleeve member. Suitable shims 62 may be used to get the proper alignment and spline engagement of hydraulic torque motor output shaft 64. Coupling hub 66 drivingly connects the output of shaft 64 and to drive shaft 46. Suitable bearings 68 are provided in support wall 70 so that drive shaft 46 may rotate freely therethrough. Similiar bearing means 72 are positioned in the front end 74 of the hollow tubular arm 75. Drive roll 50 is mounted to the end of drive shaft 46 by conventional means.

FIG. 9 shows the conversion of the 14, 21, 26 and 35 inch feed roll arm assembly. Referring thereto it is seen that hydraulic motor 52 is bolted by bolts 80 and 82 to the end of the arm 75. It is seen that the output spline shaft 84 of the hydraulic motor and the end of drive shaft 46, shown at 86, with a threaded end, is threaded into member 88 from the threaded end and splined in from the hydraulic motor end, which provides the driving connections and alignment means. This member rotates about tapered roller bearings 90. The portion of drive shaft 46 passing through the front end 92 of arm 75 also rotates in suitable roller bearings 94. Drive roll 50 is shown engaging splined portion 96 and 98 of the drive shaft and is bolted at its forward end by bolt 100 into the drive shaft. The cylindrical spiked portion 102 of the roll is shown to be welded at points 104 to the front and back plates 106 and 108.

FIGS. 3 and 4 illustrate the new construction for the arm assemblies. Hydraulic motor 52 is bolted by bolts 110 and 112 to plate 114. Sleeve 116 is welded to plate 114 at its outboard end and has a front plate 118 at its inboard or feed roller end. The drive shaft formed of cold-rolled steel is connected to the output of the hydraulic motor at 120 rotating the drive shaft in bearings 122 and 124 of sleeve 116. It can be seen that sleeve 116 extends into the cylinder defined by the spiked roller surfaces 126. Opposed generally cone shaped members 128 and 129 support the spiked cylinder. Locking fingers shown generally at 130 are attached to members 128 and 129, and are threaded onto the end of the drive shaft and are held thereto by nut 132. Comparison with FIGS. 5 and 9 reveals that this design provides for a shorter, larger diameter drive shaft with no splined portions. Also, since the bearings are closer to the load point, this is a more stable design. The end of the arm and hydraulic motor are bolted by bolts 134 to mount 136 which in turn is mounted to perpendicular pivot member 138 whereby the entire feed arm assembly can rotate about axis 140 of pivot member 138.

As was described in the prior paragraph, the feed arms are rotatably mounted to the infeed and outfeed faces of the machine. Referring to FIG. 2 the infeed tensioning system 34 will be described. As shown it essentially includes two link members 142 and 144. Link member 142 pivotally connects feed arm 40 with feed arm 42 and link member 144 likewise pivotally connects feed arm 42 and feed arm 44. An air fed cylinder means 146 is pivotally attached at one end to the support frame 22 and at the other end to feed arm 42. Thus, it is seen that when the piston rod 148 of cylinder 146 is extended each of the roller members of the feed arms are moved equal distance away from the longitudinal centerline and when the piston rod 148 is retracted into the cylinder the feed rollers are likewise moved simultaneously toward the longitudinal axis.

Figure 6:
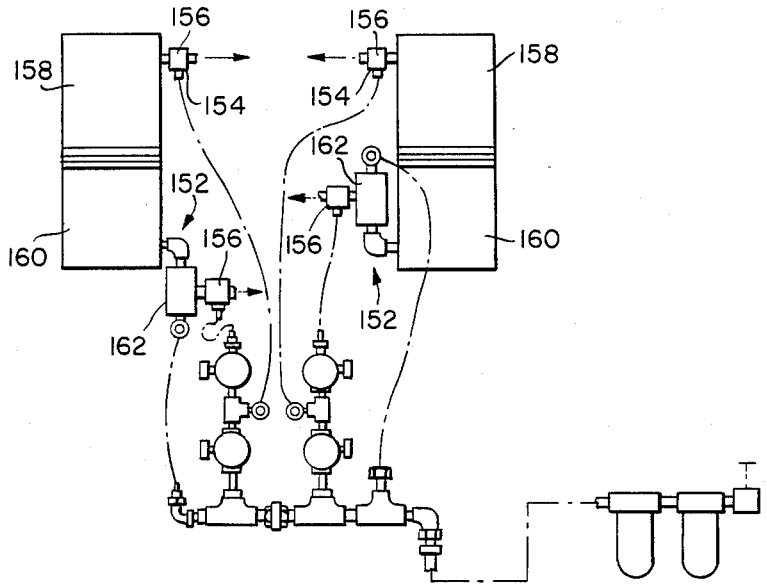
FIG. 6 is a schematic view of the feeder arm tensioning and quick jog system of FIG. 1.

It was also found that occasionally the logs to be debarked deviated from the axial alignment with the debarking machine to such an extent that the feed rollers were not capable of mounting the log and thus it was necessary to jog or quick open with a quick closure of the feed rollers so that they were then able to mount the log and grasp it for feeding. Referring to FIG. 6 this jog feature and the general tensioning system are illustrated. The arrangement includes a pair of double acting air tension cylinders each with a sliding piston 148. Attached on either end of each of the cylinders is an air inlet 152 at either end and an air inlet 154 with a quick release valve 156 at the front end. The arrangement is such that there will be retained within the cylinders a limited pressure cushion at inlet 152 which prevents the piston from slapping one end or the other as it changes direction. In one case it is 20 psi on the rear side shown at 160 and 60 psi on the front side shown at 158 with the front and rear identifying the position of the tensioning system with respect to the feed rollers. When the instance arises for the tension system to be jogged open it is possible to do so with the input of air directly to the rear of the piston by reason of the operation of the solenoid valve 162 which directs 120 psi into the rear of this cylinder to force the piston forward and thus open the feed roller, but with quick exhaust 156 returning to normal quickly which is important for proper operation. Either the infeed or the outfeed can be jogged open, since a cylinder is provided for each.

Figure 8:
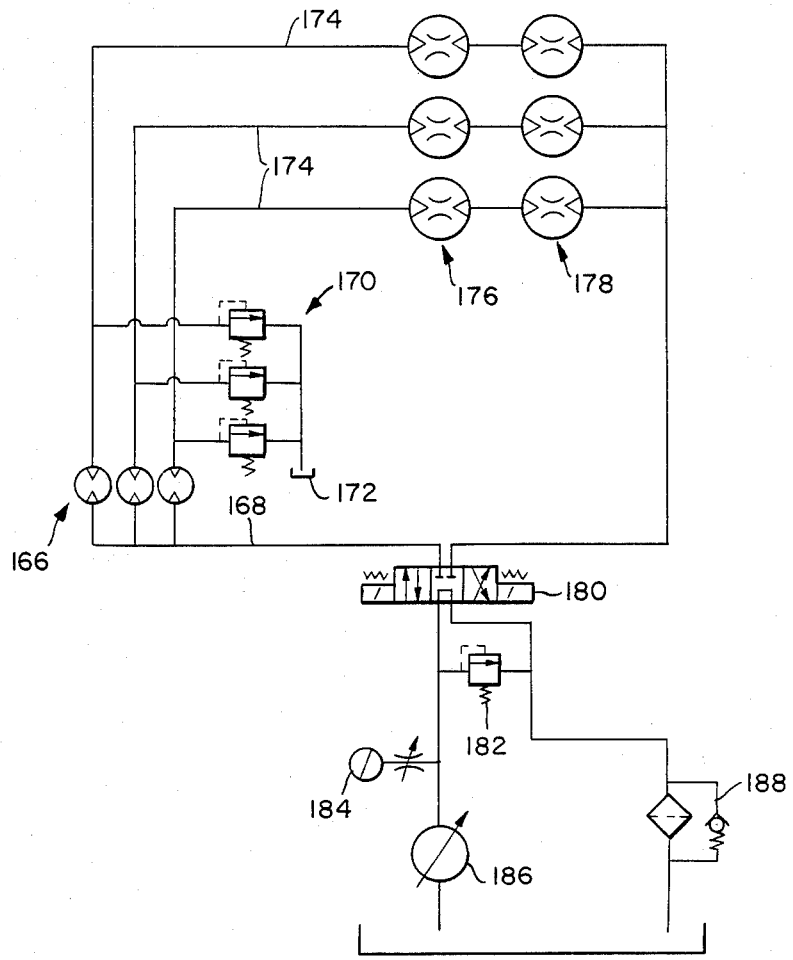
FIG. 8 is a schematic view of the hydraulic system for the feeding means of the machine of FIG. 1.

The hydraulic system for the feed rollers is illustrated in schematic form in FIG. 8. As shown on the left hand side of the drawing, a three way positive gear type flow divider 166 is provided. It receives flow, for example, of about six gallons per minute from flow line 168 and splits this into three equal volumes of flow of two gallons per minute. Associated with the three way flow divider 166 is a three way pressure relief bypass shown generally at 170 for each one of the series legs in order to dump the additional fluid that would not be necessary in the event that there was a failure of one of the feed rollers to operate. This additional dumped portion would be dumped into tank 172. It should be noted that without the three way pressure relief bypass if the flow in one of the series legs were impeded the remaining legs act as pumps or excitors to force the necessary flow of fluid through the stopped motor thereby damaging the motor. It should also be understood that properly, even when one of the motors or other ports in the system is impeded and not operating properly, all of the normal two gallon per minute flow is not dumped by way of the three way pressure relief bypass into the tank but rather some portion passes through the motor that normally powers the feed roll but without doing any work thus slowing the roller speed. In other words, the amount of fluid passing through that motor without work would not be effective to turn the motor and it would not have any rpm produced from that fluid. The series legs 174 feed into the infeed motors 176 first and then the outfeed motors 178. There is provision for an internal relief as mentioned earlier that permits the flow of fluid through the motor without work in the event that the pressure in that motor builds up beyond the optimum maximum of 2400 psi. The normal operation range is 1000 to 1500 psi and, if the 2400 psi maximum is reached due typically to the stoppage or slowdown of the feed roller, that roller will then permit the fluid to bypass through the internal or cross port relief mechanism (cross port relief) and pass through the outfeed motor. Also the fluid may pass by reason of the tolerances allowed in the motor that render the motor efficient up to 2400 psi but beyond that leakage occurs so that the pressure would not build up beyond the 2400 psi maximum. Under such circumstances the flow of hydraulic fluid performing work to maintain the original RPM substantially diminishes and due to the three way pressure relief bypass valve the fluid is dumped into the tank in large part and what ever remaining fluid that would be passed through the hydraulic motor passes to the corresponding outfeed motor which, however, may turn but the passage of fluid through that motor would not turn the infeed motor. The other rollers not so impeded continue at the speed produced by the normal two gallon flow. The internal relief mechanism can be an off the shelf hydraulic motor where the tolerances are not so great that the high pressure will continue to make the motor efficient. A typical motor that has this built in inefficiency is the T.R.W. Ross Gear Division, MAE series identified as 24002 or MAE 34002 motors and disclosed in U.S. Pat. Nos. 3,288,034, 3,289,602, 3,452,680 and 3,606,601. As best shown in FIG. 8, the hydraulic system also includes a suitable reverse valve 180, a two way relief valve 182, a pressure gauge 184, a variable volume pump 186, a pressure compensator 188 and suitable flow lines.

Figure 7:
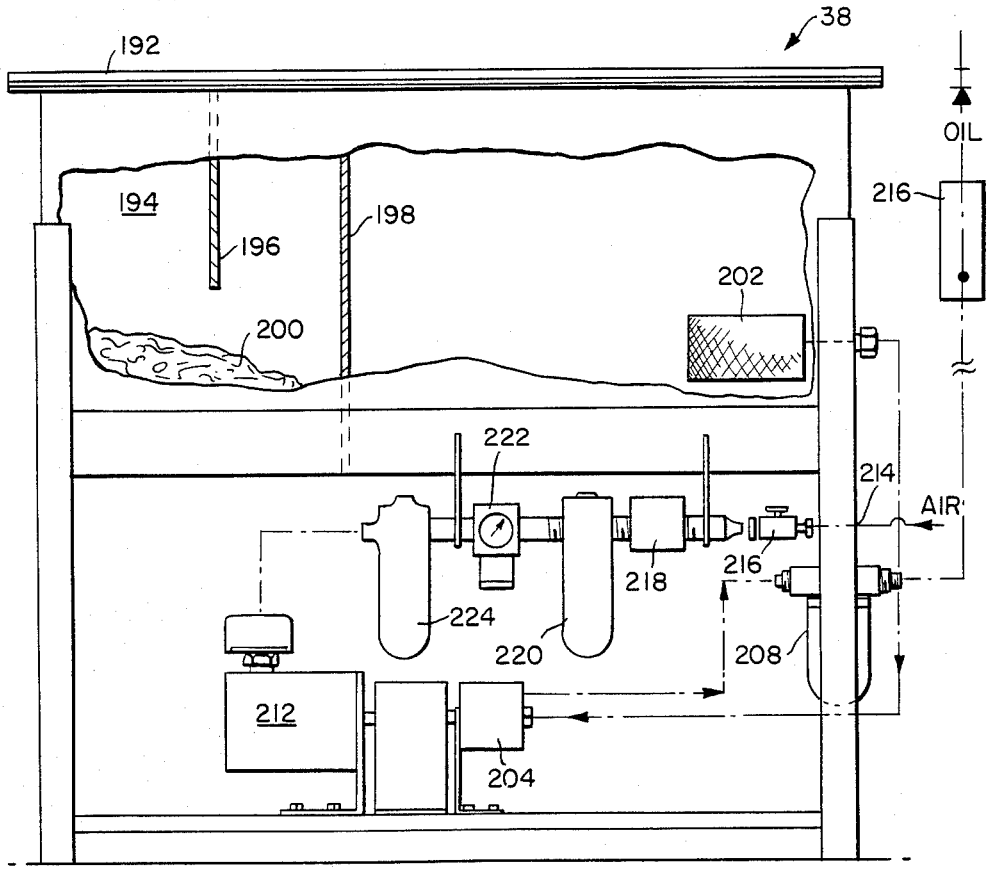
FIG. 7 is a partially broken away elevational view of the oiler for the machine of FIG. 1 which is positioned about two to ten feet below the debarking machines.

While the debarker is typically two to ten feet above the ground, the oil tank, as best shown in FIG. 7, is near ground level. The oil gravity flows down to the tank through a pipe positioned at about point 192 into oil reservoir 194 where it must pass through a pair of baffles 196 and 198. These baffles collect the dirt on the left side of the baffle and the cuttings and other debarking debris that may float on the oil remain in the reservoir and the dirt as shown at 200 settles out. The cleaned oil passes through suction filter 202 and down to pump 204 and back out through the oil filter 208. The special spring on the oil filter includes a pressure relief filter mechanism that at greater than 5 psi across the filter the oil will bypass the filter to avoid shutting down the machine due to the filter clogging. The oil then passes through a specially selected flow switch 210 which detects the flow of oil to be certain that it is one pint per minute plus or minus a half a pint and this is required to make certain that the rotor is properly oiled and that the oil does not leak out. The oil in this condition is clean and will be effective to perform the lubrication requirement without adding unduly to the maintenance requirements by reason of carrying dirt and other foreign matter as the previous lubrication systems did.

It has been found that it is very difficult if not impossible to obtain a pump that controls the flow of lubricant to within the above-mentioned tolerances and therefore the present invention includes a novel air motor shown at 212 to drive the pump and control the pump to precisely the correct oil flow, that is, by controlling the rpm on the air motor. As shown, the air comes in at 214 and passes through a flow control 216 to be certain that the proper volume of fluid enters the system. A solenoid valve 218 which is simply an on and off valve is provided. The air continues to pass through an air filter 220, through a pressure regulator 222 to maintain the pressure and then, around the maximum of about 10 psi, continues to pass through a device 224 which is simply designed to add oil to the air to lubricate the air motor. The air then passes through the air motor which is a one and a three-quarter horse-power motor that drives the pump for the oil.

The cleaned oil flows to the top of the rotor and then passes through the side through an opening and is deposited at the peak of the rotor housing from which it lubricates the rotor as it rotates. The oil just drops down to the bottom where it exits by gravity and flows down into the oil tank as previously mentioned. Thus, the oil system according to the present invention applies the oil in a closely controlled volume and also provides filtered clean oil to lubricate the rotor. This results in the proper operation of the rotor with a minimum of down time for the debarker.

A very low viscosity oil typically less than 150 cps and preferably below 100 cps is used since it can act as a flushing vehicle as well as a lubricant. Thus the various bearing parts are flushed and the dirt is not retained on the bearings so that they have better wear characteristics. The oil used in the past was necessarily of a higher viscosity to enable the oil to adhere to the chain to transport the oil to the bearings and thus would not and could not act as a flushing agent along with the required lubrication requirements.

From the foregoing detailed description, it will be evident that there are a number of changes adaptations, and modifications of the present invention which come within the province of those persons having ordinary skill in the art to which the aforementioned invention pertains. However, it is intended that all such variations not departing from the spirit of the invention be considered as within the scope thereof as limited solely by the apended claims.

I claim:

1. A log debarker comprising:

a frame, a stator supported by said frame, a rotor, a journaling means for journaling said rotor in said stator for rotation about a longitudinal axis of said rotor, a rotating means for rotating said rotor about said longitudinal axis, a plurality of debarking tools attached to said rotor, an infeed means positioned on the infeed end of said stator for feeding logs axially into said rotor, an outfeed means positioned on the opposite outfeed end of said stator, a lubricating means that uses a lubricant for lubricating said journaling means, a flushing means that uses said lubricant of said lubricating means as a flushing medium for flushing contaminants from said journaling means, and a pumping means for pumping said lubricant over said journaling means.

2. The debarker according to claim 1 including, a filtering means for filtering contaminants out of said lubricant, and said pumping means pumping said lubricant through said filtering means before pumping over said journaling means.

3. The debarker according to claim 1 including, said filtering means including a reservoir spaced below said journaling means, and said lubricant of said lubricating means flowing by gravity from the top of said journaling means, over said journaling means, and down to said reservoir.

4. The debarker according to claim 3 including, said filtering means including, positioned in said reservoir, a debris flotation means, a filtering means associated with said debris flotation means, a debris settling means, and a suction filtering means associated with said debris settling means.

5. The debarker according to claim 1 including, an air motor separate from said rotating means and operatively connected to and driving said pumping means.

6. The debarker according to claim 1 including, said flushing means including using as a flushing medium an oil having a viscosity below 100 cps.

7. The debarker according to claim 1 including, a cutoff means for disconnecting said rotating means and said power means when there is an insufficient amount of lubricant in said lubricating means reaching said journaling means.

* * * * *